US008353734B1

(12) United States Patent
Williams

(10) Patent No.: US 8,353,734 B1
(45) Date of Patent: Jan. 15, 2013

(54) SELF-CONTAINED HYDRAULIC THRUSTER FOR VESSEL

(76) Inventor: John T. Williams, DeLand, FL (US)

( * ) Notice: Subject to any disclaimer, the term of this patent is extended or adjusted under 35 U.S.C. 154(b) by 197 days.

(21) Appl. No.: 12/924,356

(22) Filed: Sep. 24, 2010

Related U.S. Application Data

(63) Continuation-in-part of application No. 12/806,274, filed on Aug. 9, 2010, which is a continuation-in-part of application No. 12/800,026, filed on May 6, 2010, which is a continuation-in-part of application No. 12/381,245, filed on Mar. 10, 2009, now Pat. No. 7,883,384, which is a continuation-in-part of application No. 11/999,531, filed on Dec. 6, 2007, now Pat. No. 7,654,875.

(60) Provisional application No. 60/903,400, filed on Feb. 26, 2007.

(51) Int. Cl.
*B63H 21/12* (2006.01)

(52) U.S. Cl. ..... 440/5; 114/151

(58) Field of Classification Search ..... 440/5, 6, 440/61 A, 61 R; 114/150, 151
See application file for complete search history.

(56) References Cited

U.S. PATENT DOCUMENTS

| | | | | |
|---|---|---|---|---|
| 583,740 | A | 6/1897 | Fryer | |
| 2,486,049 | A | 10/1949 | Miller | |
| 2,766,715 | A | 10/1956 | Waterval | |
| 2,936,730 | A | 5/1960 | Patty, Jr. | |
| 3,010,424 | A | 11/1961 | Peterson et al. | |
| 3,139,062 | A | 6/1964 | Keefe | |
| 4,358,280 | A | 11/1982 | Jeanson et al. | |
| 4,645,463 | A | 2/1987 | Arneson | |
| 4,848,702 | A | 7/1989 | Riggins | |
| 4,878,864 | A | 11/1989 | Van Bentem | |
| 5,249,378 | A | 10/1993 | Frame | |
| 5,476,400 | A | 12/1995 | Theophanides | |
| 6,234,854 | B1 | 5/2001 | Rydzewski | |
| 6,375,524 | B1 | 4/2002 | Commandeur et al. | |
| 6,409,556 | B1 | 6/2002 | Vance | |
| 6,672,236 | B1 | 1/2004 | Pinsof | |
| 6,799,528 | B1 | 10/2004 | Bekker | |
| 6,814,636 | B2 | 11/2004 | Nolen | |
| 7,163,427 | B1 | 1/2007 | Lee | |
| 7,654,875 | B1 * | 2/2010 | Williams | 440/5 |
| 7,883,384 | B1 * | 2/2011 | Williams | 440/5 |
| 2007/0087638 | A1 | 4/2007 | Dulgur | |

* cited by examiner

*Primary Examiner* — Lars A Olson
(74) *Attorney, Agent, or Firm* — Paul S. Rooy, PA

(57) ABSTRACT

A self-contained hydraulic thruster for vessel. The hydraulic thruster incorporates at least one lower unit housing tiltably attached to a base at a base lower unit cutout laterally offset from a helm platform. Tilt actuator(s) disposed entirely above a base upper surface tilt each lower unit up or down relative to the base. Two positive down-tilt means are disclosed: housing arm lower edge(s) resting on the base upper surface, and also down stop tab(s) extending from a base lower unit cutout wall into the base lower unit cutout against which a forward housing wall edge butts when the housing is tilted fully down. In addition, base bores through the base are disclosed, and pins which slidably fit into respective base bores and extend downwards from the base to serve as positioning stops when installing the hydraulic thruster on a vessel.

30 Claims, 8 Drawing Sheets

SELF-CONTAINED HYDRAULIC THRUSTER FOR VESSEL

CLAIM FOR PRIORITY

This utility patent application is a Continuation-In-Part of pending U.S. utility application Ser. No. 12/806,274 filed Aug. 9, 2010 entitled Hydraulic Thruster for Vessel; which was a Continuation-In-Part of pending U.S. utility application Ser. No. 12/800,026 filed May 6, 2010 entitled Modular Hydraulic Thruster System for Vessel; which was a Continuation-In-Part of pending U.S. utility application Ser. No. 12/381,245 filed Mar. 10, 2009 now U.S. Pat. No. 7,883,384 entitled Self-Contained Hydraulic Thruster for Vessel; which was a Continuation-In-Part of U.S. utility application Ser. No. 11/999,531 filed Dec. 6, 2007 entitled Self-Contained Hydraulic Thruster for Vessel which issued as U.S. Pat. No. 7,654,875 on Feb. 2, 2010; which was based upon U.S. provisional patent application Ser. No. 60/903,400 filed Feb. 26, 2007 entitled Self-Contained Hydraulic Thruster for Vessel; and claims the benefit of the earlier filing date of these applications.

BACKGROUND OF THE INVENTION

1. Field of the Invention

This invention relates to vessel propulsion systems, and in particular to a self-contained hydraulic thruster for vessel.

2. Background of the Invention

Marine thrusters typically mount on barges and flat boats, and are used as propulsion for these vessels. One type of marine thruster employs a prime mover such as a diesel engine driving a hydraulic pump, together known as a "power pack", and the resultant pressurized hydraulic fluid may be employed to drive a propeller attached to a lower unit.

One major problem associated with marine thrusters has been that where a centrally located tiltable lower unit has been retracted and tilted backwards for storage, maintenance, cleaning, etc., the protruding upper end of the lower unit interferes with the helm and helm platform, and prevents full upward tilting of the retracted lower unit. This problem was solved by U.S. Pat. No. 7,654,875 granted to Williams, incorporated hereinto by reference, which provided lower units laterally offset from a base and helm platform, thus avoiding interference between the lower unit(s) and helm platform when tilting retracted lower unit(s) forward for storage or shipping.

However, there are still a number of problems associated with currently available marine thrusters. One problem is the absence of a strong, redundant tilt actuator system whose components are not immersed in water, thus reducing corrosion due to moisture.

Another challenge involves providing positive down-tilt stops which provide mechanical end-of-downwards-tilt travel stops, so that the lower unit is held securely vertical when tilted down, especially when developing thrust.

Still another problem is being able to provide means to position the marine thruster on a vessel deck without permanent downwards-protruding member(s), because such downwards-protruding member(s) interfere with storage and shipping by increasing the overall height of the unit.

Another problem with current designs is the lack of an effective extension and retraction mechanism for lower units which provides long extension/retraction travel. Long travel extension is especially important where the hydraulic thruster is to be installed on deep draft vessels.

SUMMARY OF THE INVENTION

It an object of this invention to provide a self-contained hydraulic thruster for vessel which provides a lower unit tilting means which is entirely above water level. Design features allowing this object to be achieved include a lower unit tiltably attached to a base, a housing arm attached to a housing and extending upwards from said housing, and a tilt actuator attached at one end to a distal end of the housing arm and at the other end to the base upper surface. Benefits associated with reaching this objective include reduction in moisture exposure to the tilt actuator, and associated cost savings in avoided oxidation damage and maintenance expense.

It is another object of this invention to provide a self-contained hydraulic thruster for vessel which provides positive down-tilt stops. Design features allowing this object to be achieved include a housing tiltably attached to a base at a pivot point, the pivot point being positioned at a front area of a housing wall such that a portion of the housing wall extends above a base upper surface when the housing is tilted completely down, a housing arm having a housing arm lower edge, each housing arm being attached to an aft area of its housing wall such that the housing arm lower edge rests on a base upper surface when the housing is tilted completely down. An additional down-tilt stop is provided by a down stop tab rigidly attached to a base lower unit cutout wall which extends into the lower unit cutout, so that when the housing is tilted completely down, a front edge of the housing wall butts against the down stop tab. Benefits associated with reaching this objective include more stable down-tilt stop function when the lower unit is in forward thrust, stronger and more solid lower unit installation, and increased ease of operation.

It is still another object of this invention to provide a self-contained hydraulic thruster for vessel incorporating provisions for accurately positioning the hydraulic thruster on the stern of a vessel to which it is to be attached. Design features allowing this object to be achieved include a pair of base bores through a base, and a pin corresponding to each base bore sized to slidably fit through a respective base bore which protrudes below the base to serve as a stop to a hydraulic thruster on a vessel stern, for subsequent permanent attachment, the pin being removable for storage or transportation of the hydraulic thruster. Benefits associated with reaching this objective include more accurate hydraulic thruster positioning, installation time savings, and the associated hydraulic thruster installation cost savings.

It is another object of the present invention to provide a self-contained hydraulic thruster for vessel whose lower unit (s) may be retracted and tilted up without interference from the helm platform. Design features allowing this object to be accomplished include at least one lower unit tiltably mounted to a base, laterally offset from a steering platform. Advantages associated with the accomplishment of this object include more efficient lower unit stowing for storage and/or transportation, greater tilt achievable (close to 90 degrees), the ability to tilt the propellers and lower unit completely out of the water for servicing and cleaning, decreased corrosion due to the ability of getting the lower units and propellers completely out of the water when not in use to reduce corrosion, and greater retraction of the lower unit.

It is another object of the present invention to provide a self-contained hydraulic thruster for vessel which allows long-travel extension and retraction. Design features allowing this object to be accomplished include a lower unit tiltably attached to a base, a cylinder through and extending downwards from a housing, a tube slidably and rotatably disposed within the cylinder, a ratio of a length of the cylinder to a length of the tube being substantially between 0.25 and 0.35, and long travel extension actuators whose lower end is attached at a lower end of the cylinder and whose upper end is attached to an extension collar encircling an upper end of the tube. Benefits associated with the accomplishment of this object include increased flexibility of installation on deep-hulled vessels, and flexibility of operation.

It is yet another object of this invention to provide a self-contained hydraulic thruster for vessel which is economical to build. Design features allowing this object to be achieved include the use of components made of readily available materials, and commercially available components such as an existing steering motor, overhung load adapter, hydraulic actuator, hydraulic power pack, hydraulic fluid reservoir, lower unit, propeller, steering gear, drive gear, and hydraulic lines. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Eight sheets of drawings are provided. Sheet one contains FIG. 1. Sheet two contains FIG. 2. Sheet three contains FIG. 3. Sheet four contains FIG. 4. Sheet five contains FIG. 5. Sheet six contains FIG. 6. Sheet seven contains FIGS. 7 and 8. Sheet eight contains FIG. 9.

DETAILED DESCRIPTION OF THE PREFERRED EMBODIMENT

Figure 1:
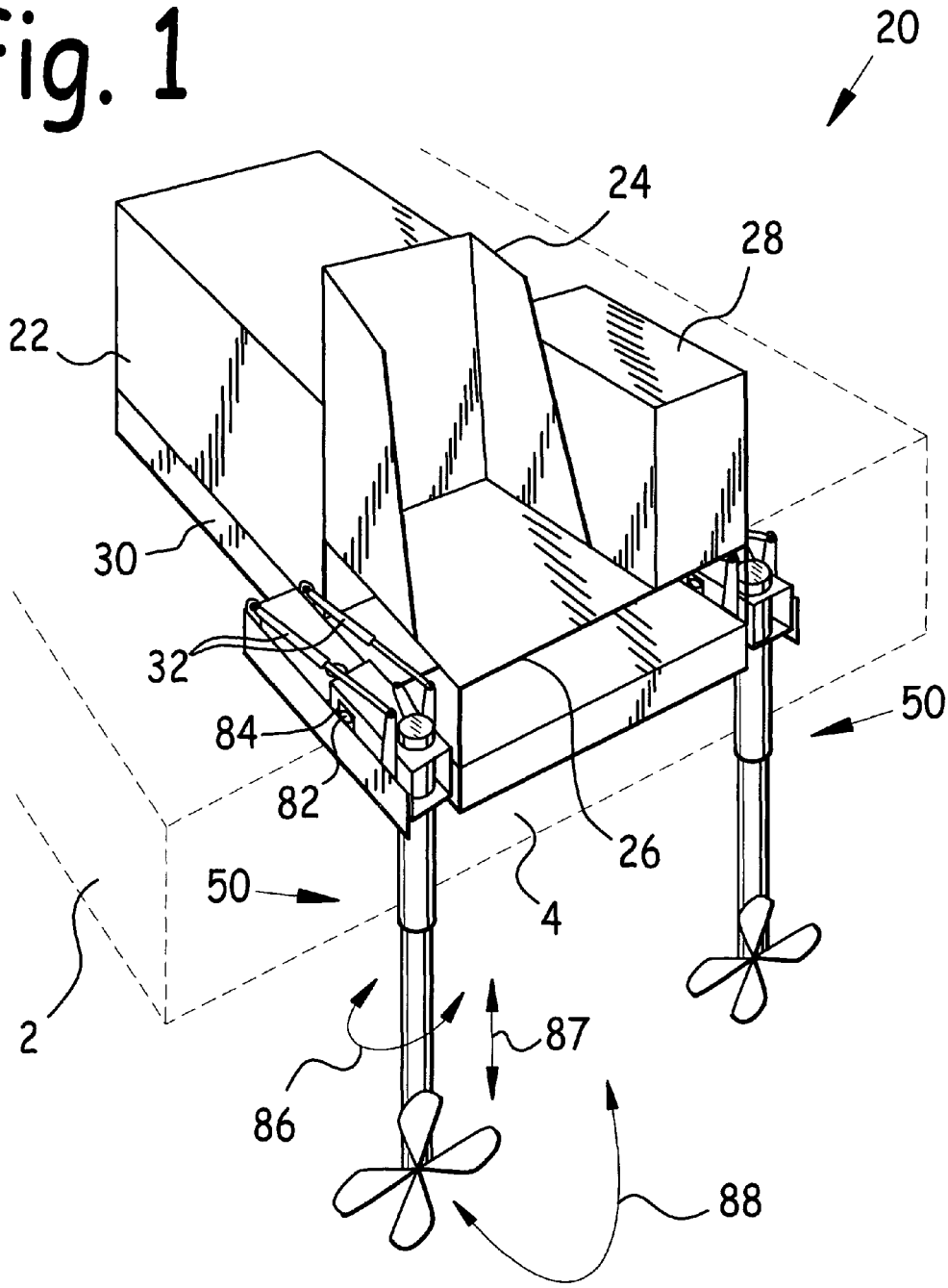
FIG. 1 is an elevated left rear quarter isometric view of a hydraulic thruster mounted on a vessel.

FIG. 1 is an elevated left rear quarter isometric view of hydraulic thruster 20 mounted at vessel stern 4 of vessel 2. As may be observed in this drawing, hydraulic thruster 20 comprises hydraulic power pack 22 and helm platform 26 mounted atop base 30. Helm 24 and hydraulic fluid reservoir 28 are mounted on helm platform 26. Helm platform 26 is mounted some height above base 30, which aids the feeding of hydraulic fluid in hydraulic fluid reservoir 28 to hydraulic power pack 22.

Hydraulic power pack 22 is mounted at the front of base 30, while helm platform 26 is mounted at the rear of base 30. Helm 24 and hydraulic fluid reservoir 28 are mounted side-by-side atop helm platform 26.

Hydraulic thruster 20 comprises at least one lower unit 50 pivotally attached to base 30 at the rear edge of base 30. The embodiments depicted in FIGS. 1-3 depict two lower units 50 tiltably attached to base 30, one at the left rear of base 30, and the other at the right rear of base 30.

Figure 2:
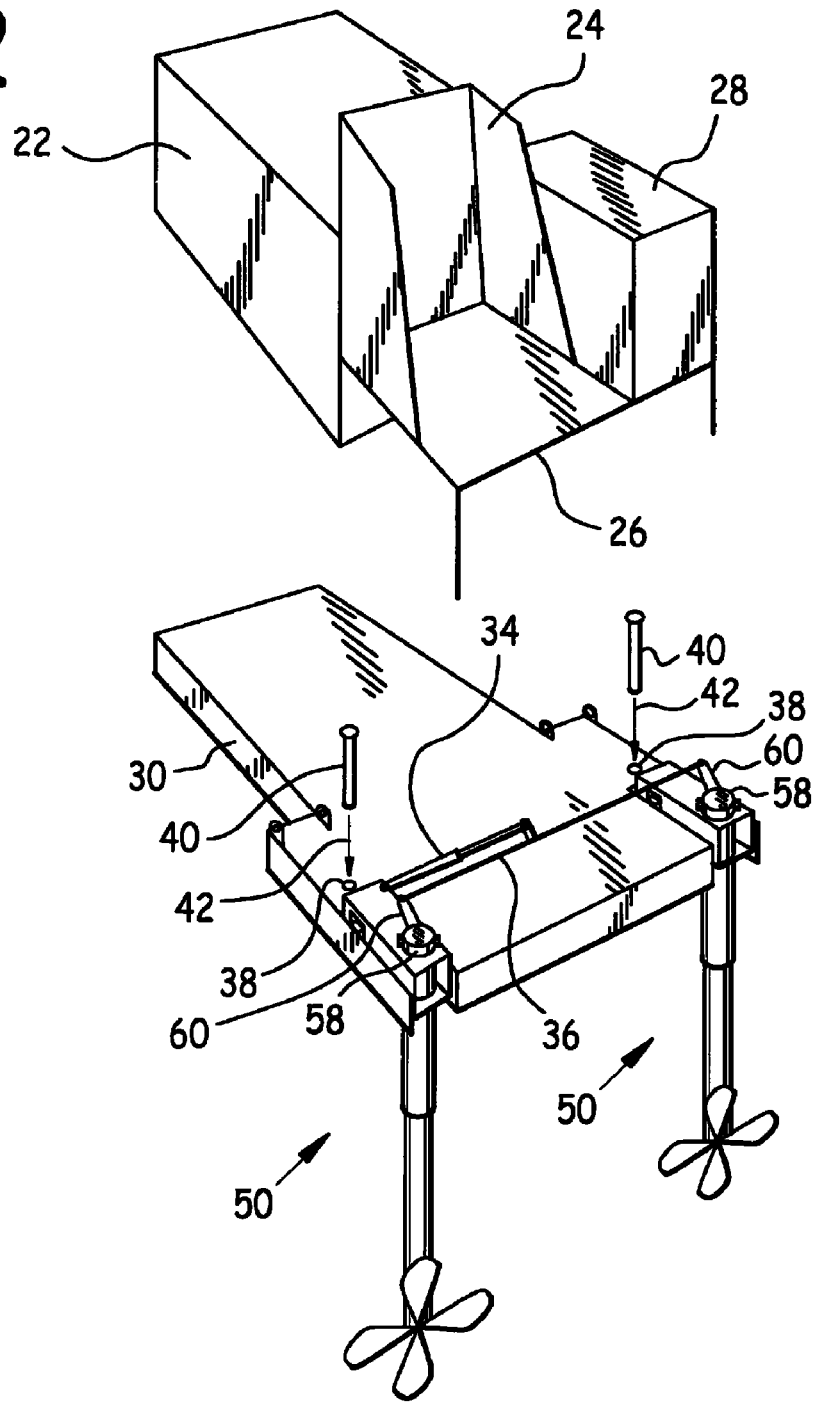
FIG. 2 is an elevated left rear quarter isometric view of a hydraulic thruster, with its hydraulic power pack, helm, helm platform, and hydraulic fluid reservoir removed, and depicting a steering actuator and tie rod steering system.
Figure 3:
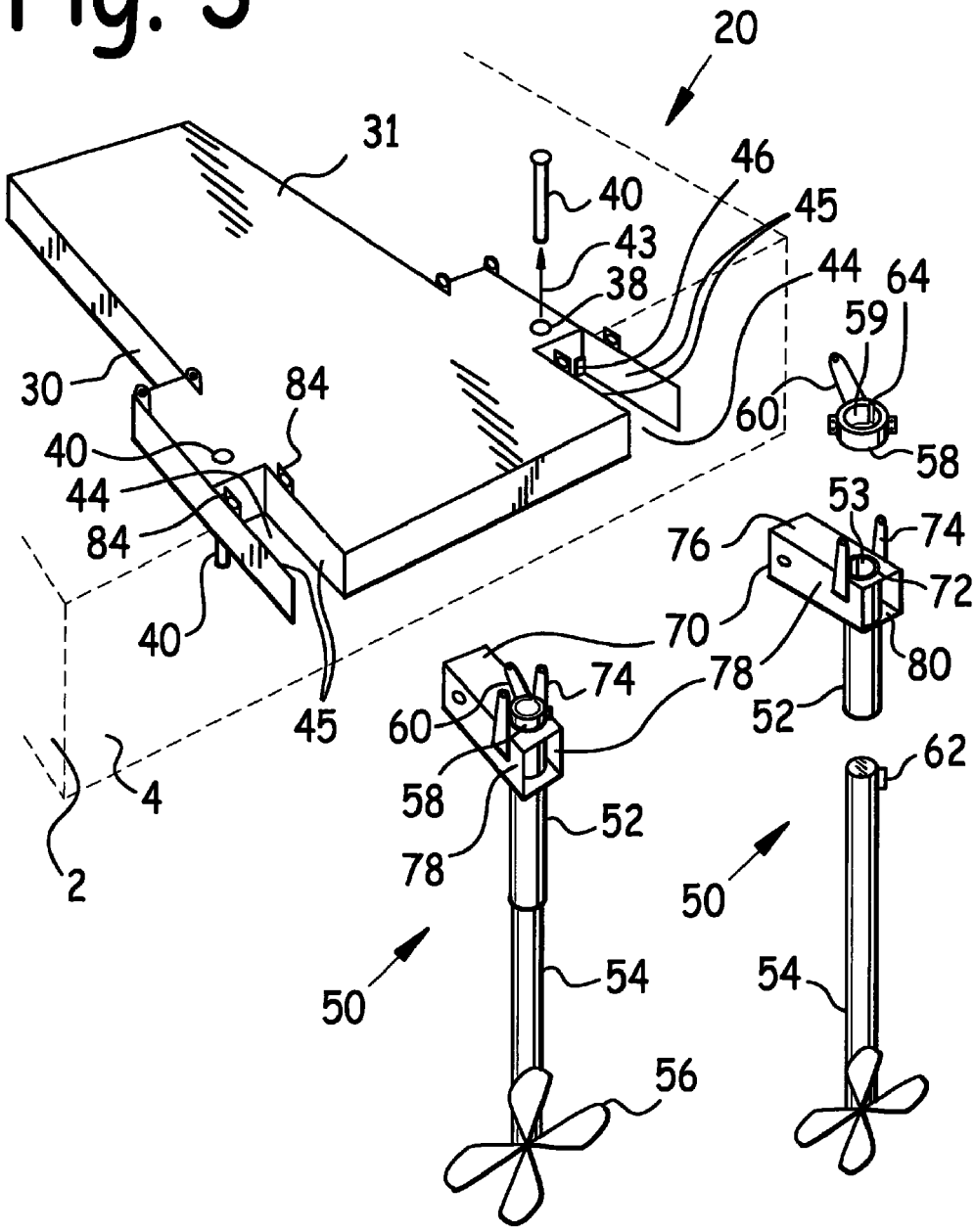
FIG. 3 is an elevated left rear quarter isometric view of a base with lower units removed, illustrating pins being used to position the thruster base on a vessel at the vessel stern.

FIG. 2 is an elevated left rear quarter isometric view of hydraulic thruster 20, with its hydraulic power pack 22, helm 24, helm platform 26, and hydraulic fluid reservoir 28 removed, and depicting a steering actuator 34 and tie rod 36 steering system. FIG. 3 is an elevated left rear quarter isometric view of base 30 with lower units 50 removed, illustrating pins 40 being used to position base 30 on vessel 2 relative to vessel stern 4.

Each lower unit 50 comprises a cylinder 52 rigidly attached to a housing 70. In the preferred embodiment, housing 70 was rectangular in cross-section, and comprised housing roof 76, housing sides 78, and housing floor 80. A housing cylinder bore 72 was disposed in housing roof 76, and a housing cylinder bore 72 was disposed in housing floor 80. Each housing cylinder bore was sized to admit cylinder 52, which was disposed through housing cylinder bores 72, and immobilized therein, largely extending downwards from housing 70.

Cylinder 52 comprises cylinder bore 53 sized to slidably and rotatably admit tube 54. Propeller 56 is disposed at a lower end of tube 54, and when spinning provides thrust for hydraulic thruster 20. Tube 54 is slidably and rotatably disposed within cylinder 52. Steering function is achieved by rotating tube 54 and propeller 56 relative to cylinder 52 as indicated by arrow 86 in FIG. 1.

It may be noted that cylinder 52 extends through, and extends downwards from, housing 70. The axial length of cylinder 52 as compared to the axial length of tube 54 is significant, because a cylinder 52 of substantial length relative to the length of tube 54 permits long travel extension and retraction of tube 54, because a long cylinder 52 provides support for tube 54 during such extension and retraction. For example, it was determined experimentally that tubes having lengths of 12 feet, 10.5 feet, and 7⅓ feet, are adequately supported by corresponding cylinders having a length of 4 feet, 3 feet and 2 feet respectively. Thus, the optimum ratio of cylinder 52 length to tube 54 length is substantially between 25% and 35%.

In the embodiment hydraulic thruster 20 depicted in FIGS. 1-3, steering clamp 58 having steering clamp aperture 59 is disposed directly atop housing roof 76. Steering clamp aperture 59 is sized to slidably admit tube 54 when steering clamp 58 is loose. When steering clamp 58 is tightened, steering clamp 58 frictionally grips tube 54 within steering clamp aperture 59, and then tube 54 is not free to translate nor rotate relative to steering clamp 58.

When tube 54 is to be extended or retracted relative to housing 70 and steering clamp 58 as indicated by arrow 87 in FIG. 1, steering clamp 58 must be loosened to allow tube 54 to slide through steering clamp bore 59. When tube 54 is retracted or extended to an amount desired, steering clamp 58 is tightened, to permit the steering function when lower unit 50 is tilted down and tube 54 is extended downwards for thrusting, and to prevent uncommanded extension when tube 54 is retracted upwards relative to housing 70.

To aid in the steering function, tube 54 comprises tube key 62 extending radially outwards from the upper end of tube 54, and corresponding steering clamp keyway 64 in steering clamp aperture 59 sized to slidably admit tube key 62. When tube 54 is extended fully downwards relative to cylinder 52, tube key 62 slides into steering clamp keyway 64, thus further helping prevent tube 54 from rotating relative to steering clamp 58.

Steering clamp 58 further comprises steering clamp arm 60 extending radially outwards from an upper end of steering clamp 58. In the dual-lower unit embodiment depicted in FIGS. 1-3, tie rod 36 connects ends of steering clamp arms 60 opposite steering clamps 58, which are the distal ends of steering clamp arms 60. Steering actuator 34 is attached at one end to tie rod 36, and at an opposite end to a housing 70. In the preferred embodiment, steering actuator 34 was a hydraulic cylinder.

Base 30 comprises at least one base lower unit cutout 44 at its rear edge, sized to slidably admit housing 70. Each housing 70 is rotatably attached to base 30, and rotatably disposed within a corresponding base lower unit cutout 44.

Disposed immediately forward of each base lower unit cutout 44 is a base bore 38 extending through base 3. A pin 40 is provided associated with each base bore 38 which slidably fits into its respective base bore 38. A length of pin 40 exceeds a thickness of base 3, such that when pin 40 is inserted through base bore 38 as indicated by arrows 42 in FIG. 2, a substantial length of pin 40 protrudes through the bottom of base 3 to butt against vessel stern 4, as shown in FIGS. 3 and 6.

Figure 6:
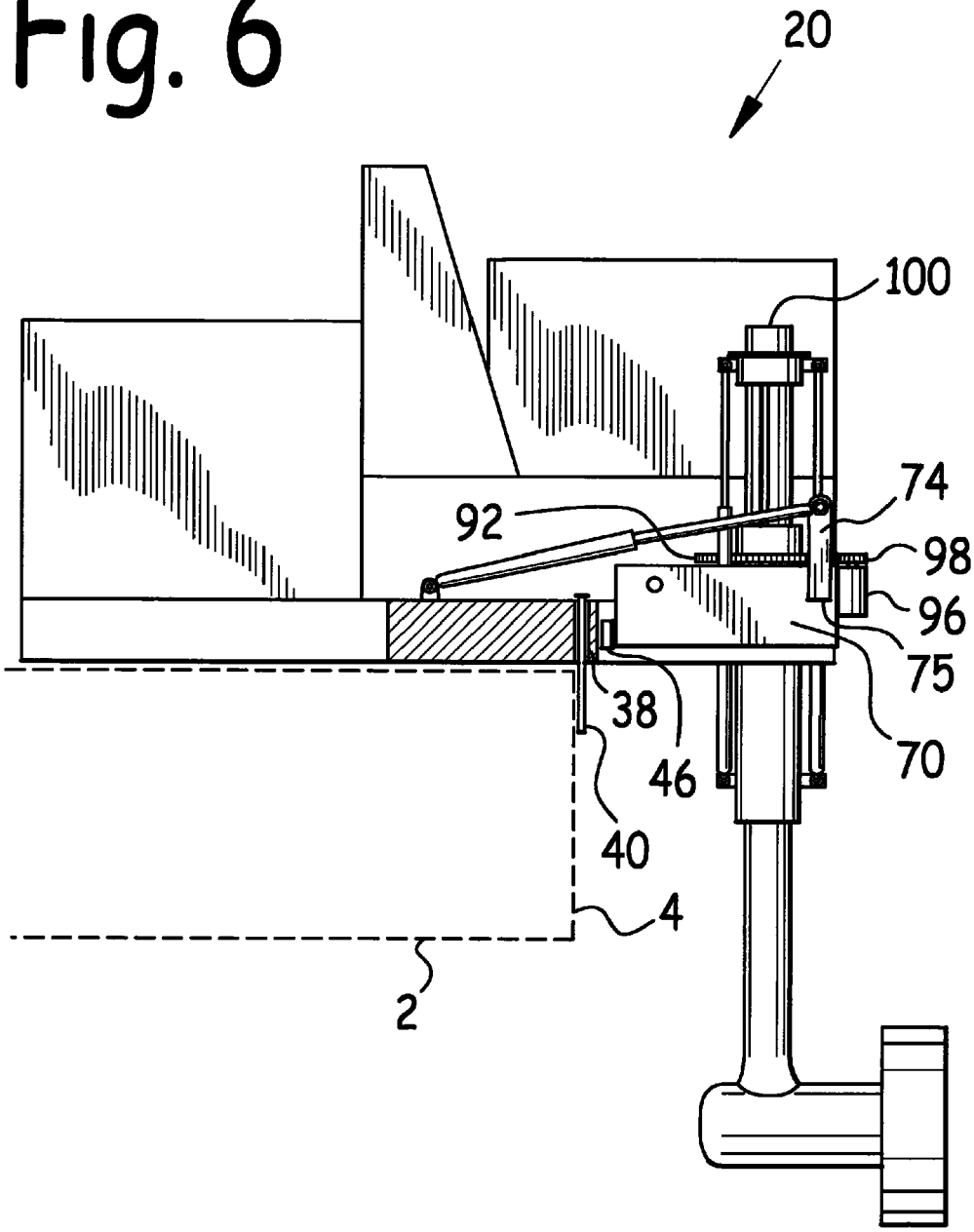
FIG. 6 is a side cross-sectional view of a self-contained hydraulic thruster for vessel with its lower unit tilted down by its tilt actuators, with its tube extended relative to its cylinder by means of its extension actuators, depicting a steering motor and tube gear steering system, and showing pins being used to position the thruster on a vessel at the vessel stern.

Once pins 40 are inserted through respective base bores 38 as indicated by arrows 42 in FIG. 2, base 30 is positioned on vessel 2 such that both pins 40 butt up against vessel stern 4 as depicted in FIGS. 3 and 6, thus accurately positioning hydraulic thruster 20 on vessel 2 at vessel stern 4. Base 3 may then be attached to vessel 2 by any appropriate means, such as welding, bolting, bolting to weld tabs, etc. Pins 40 may then be removed from their respective base bores 38 until further needed.

Figure 5:
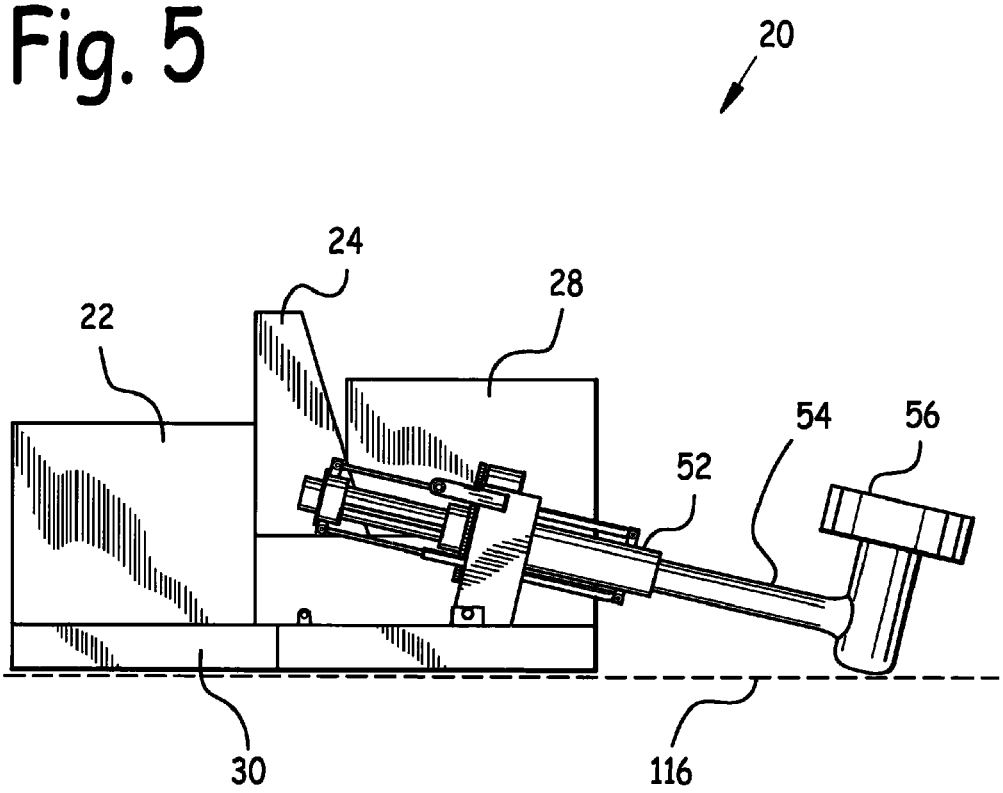
FIG. 5 is a side view of a self-contained hydraulic thruster for vessel with its lower unit tilted up by its tilt actuators, and with its tube retracted relative to its cylinder by means of its extension actuators, resting on a flat surface for storage or transportation.

It is important to note that pins 40 are removed from base 3 as indicated by arrow 43 in FIG. 3, for shipping and storage of hydraulic unit 20, such as is depicted in FIG. 5. When pins 40 are removed, base 3 may rest flat upon flat surface 116 of a container, flatbed truck, rail car, warehouse floor, etc., where hydraulic thruster 20 is to be transported or stored.

Each lower unit 50 comprises at least one upright, parallel housing arm 74, each housing arm 74 being substantially parallel to tube 54 and cylinder 52, and extending upwards from housing roof 76 in a direction substantially parallel to housing roof 70.

Each lower unit 50 further comprise a pair of tilt actuators 32, which tilt lower unit 50 as indicated by arrow 88 in FIG. 1. One end of each tilt actuator 32 is attached to an end of a housing arm 74 opposite housing 70; the other end of each tilt actuator 32 is attached to base upper surface 31. Thus, tilt actuators 32 are not immersed in water, but rather are disposed entirely above base upper surface 31, which helps protect tilt actuators 32 from water-induced corrosion.

Lower units 50 are tiltably attached to base 30. Extension and retraction of tilt actuators 32 cause lower units 50 to tilt down and up relative to base 30. In the preferred embodiment, a pivot tab 84 extends upwards from base upper surface 31 on either side of base lower unit cutout 44. Each pivot tab 84 contains a pivot point 82 which is pivotally attached to a forward part of a respective housing side 78.

Pivot tabs 84 have the effect of elevating pivot point 82 (which is the point at which lower unit 50 is tiltably attached to base 30) above base upper surface 31, which facilitates rotation of housing 70 relative to base 30 by reducing the clearance required between the forward end of housing 70 and the forward end of the base lower unit cutout within which it resides.

Another function of elevation pivot points 82 above base 30 is to elevate housing roof 76 above base upper surface 31. In the preferred embodiment base upper surface 31 was disposed at substantially the mid-height of housing sides 78. This positioning of housing 70 allows housing arms 74 to be securely attached to respective housing sides 78 (e.g. by welding), yet also allows housing arm lower edge 75 to be disposed at approximately the mid-height of housing side 78. This positioning of housing arm 74 allows housing arm lower edge 75 to rest on base upper surface 31 when lower unit 50 is tilted completely down, thus providing one of the two types of positive down-tilt stop of the instant design. The other type of positive down-tilt stop incorporated into the instant design is down stop tab 46, depicted in FIGS. 3 and 4.

Figure 4:
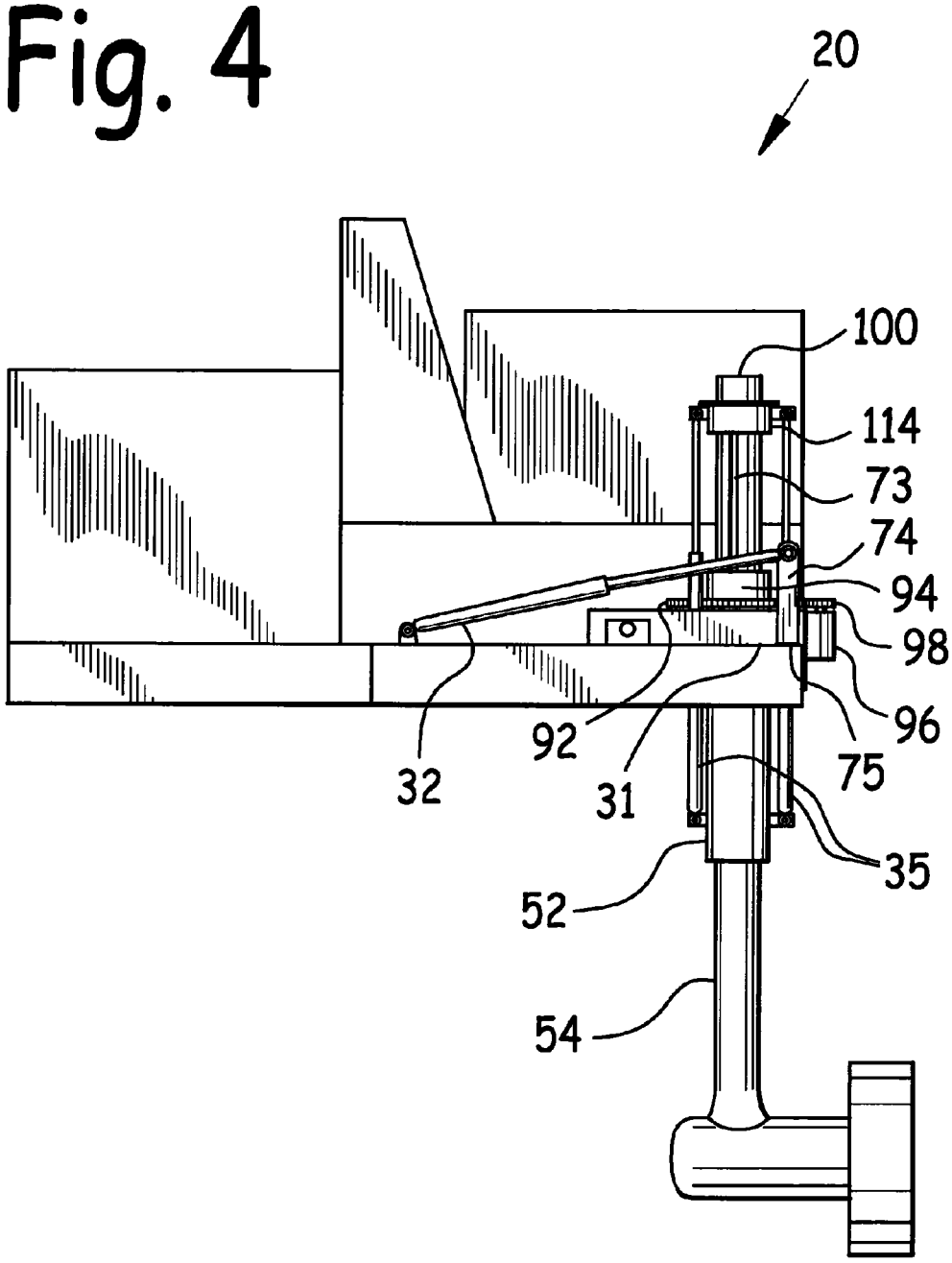
FIG. 4 is a side view of a self-contained hydraulic thruster for vessel with its lower unit tilted down by its tilt actuators, and with its tube retracted relative to its cylinder by means of its extension actuators.

The other type of positive down-tilt stop incorporated into the instant design is down stop tab 46, depicted in FIGS. 3 and 4. A down stop tab 46 is attached to a respective base lower unit cutout wall 45, positioned so that the front edge of a respective housing wall 78 butts against the down stop tab 46 when lower unit 50 is tilted completely down. This configuration is depicted in FIG. 4.

In this disclosure, the "forward" area of any component of the instant invention refers to the area closest to the bow of a vessel 2 upon which hydraulic thruster 20 is mounted, while the "aft" area of any component of the instant invention refers to the area closest to the vessel stern 4 at which hydraulic thruster 20 is mounted. Expressed another way, because hydraulic power pack 22 is mounted at the forward end of base 30 and cylinders 52 are mounted at the aft end of base 30, the "forward" area of any component of the instant invention refers to the area closest to hydraulic power pack 22, while the "aft" area of any component of the instant invention refers to the area closest cylinders 52. Laterally offset means displaced sideways in a direction perpendicular to the forward/aft axis of hydraulic thruster 20.

FIG. 4 is a side view of self-contained hydraulic thruster 20 for vessel with its lower unit 50 tilted down by tilt actuators 32, and with its tube 54 retracted relative to its cylinder 52 by means of extension actuators 35. FIG. 5 is a side view of self-contained hydraulic thruster 20 for vessel with its lower unit 50 tilted up by tilt actuators 32, and with its tube 54 retracted relative to its cylinder 52 by means of extension actuators 35. FIG. 6 is a side cross-sectional view of self-contained hydraulic thruster 20 for vessel with its lower unit 50 tilted down by tilt actuators 32, and with its tube 54 extended relative to its cylinder 52 by means of extension actuators 35. FIGS. 4-6 also depict a steering motor 96 and tube gear 92 steering system, which is used in the single lower unit 50 hydraulic thruster depicted in FIG. 9.

As may be observed in these figures, lower unit 50 may include a pair of extension actuators 35 whereby tube 54 may be extended and retracted relative to cylinder 52. One end of extension actuator 35 is attached to a lower end of cylinder 52, and the other end of extension actuator 35 is attached to actuator collar 114.

Actuator collar 114 slidably encircles the upper end of cube 54, and its upper surface butts up against the lower surface of swivel union 100, which is attached to the upper end of tube 54.

When extension actuators 35 urge actuator collar 114 upwards relative to cylinder 52 in order to retract tube 54, actuator collar 114 pushes swivel union 100 upwards, and so also tube 54 en train with swivel union 100.

When extension actuators 35 retract, actuator collar 114 descends under the influence of gravity, and so also do swivel union 100 and the tube 54 to which it is attached, en train, also under the influence of gravity, thus extending tube 54.

In the preferred embodiment, two actuators 34 were installed on each lower unit 50, substantially diametrically opposed from each other relative to cylinder 52.

As noted above, one function of elevation pivot points 82 above base 30 is to elevate housing roof 76 above base upper surface 31, thus allowing housing arms 74 to be securely attached to respective housing sides 78 (e.g. by welding), yet allowing housing arm lower edge 75 to reside at the approximate mid-height of housing side 78. This positioning of housing arm 74 allows housing arm lower edge 75 to rest on base upper surface 31 when lower unit 50 is tilted completely down as depicted in FIG. 4, thus providing one of the two types of positive down-tilt stop of the instant design.

Because the instant design incorporates two housing arms 74, each attached to a respective housing side 78, and associated with each housing arm 74 is a housing arm lower edge 75, each disposed at the approximate mid-height of the housing side 78 to which it is attached, the instant pair of housing arms 74 associated with each lower unit 50 of the instant design provide two positive down-tilt stops to each lower unit 50, where each of the two associated housing arm lower edges 75 come into contact with, and rest upon, base upper surface 31 when the lower unit 50 is tilted completely down. This configuration is depicted in FIG. 4.

It can be readily appreciated that because each base lower unit cutout 44 incorporates two base lower unit cutout walls 45, up to two down stop tabs 46 may be mounted in each base lower unit cutout, one attached to each associated base lower unit cutout walls 45. In this situation, a total of four positive tilt down-stops are provided to each lower unit 50: two housing arm lower edges 75 firmly resting on base upper surface 31, and two down stop tabs 46 against which the forward edges of respective housing walls 78 butt against.

Figure 9:
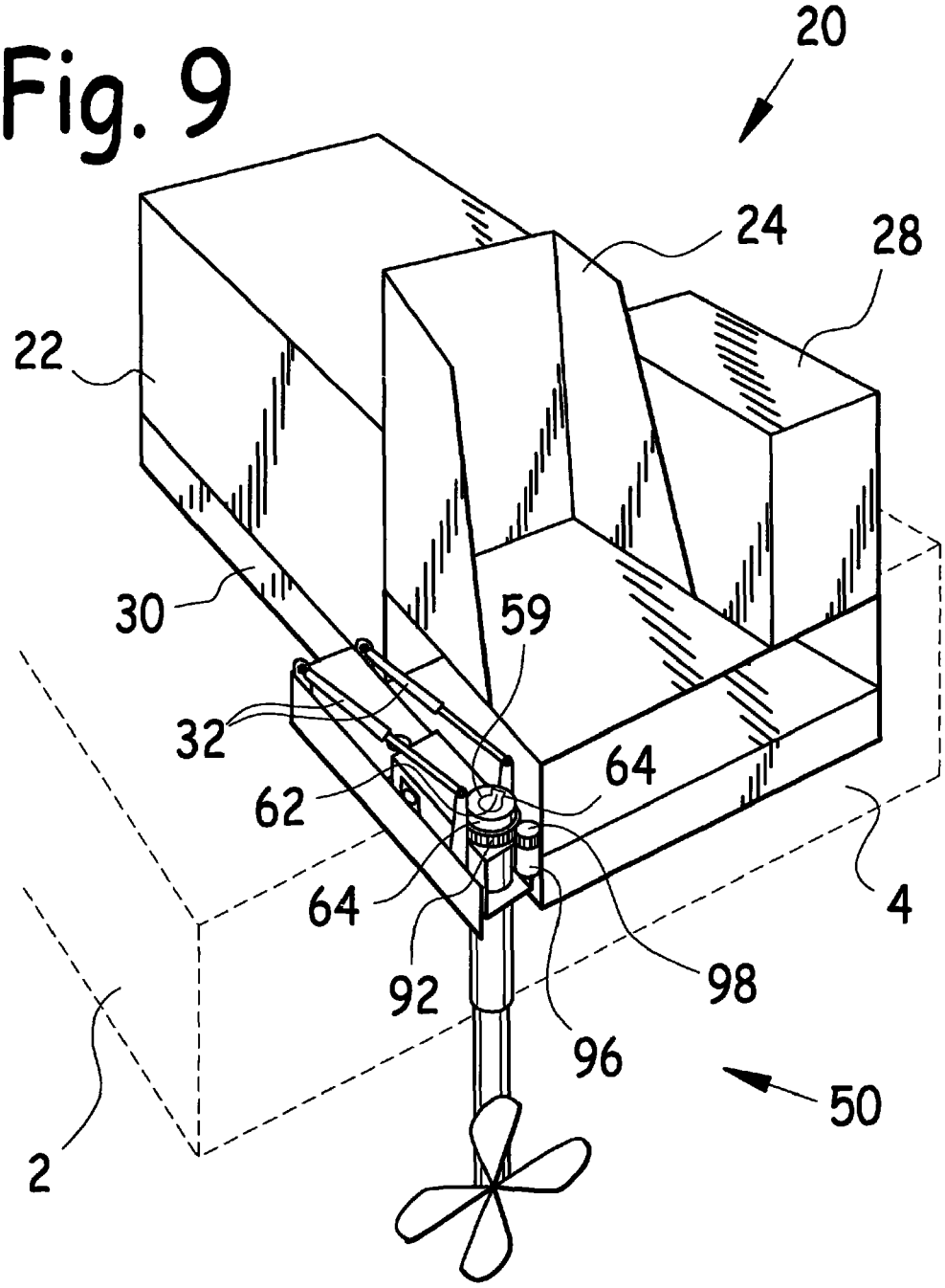
FIG. 9 is an elevated left rear quarter isometric views of a hydraulic thruster having a single lower unit.

As may be noted in FIGS. 4-6, hydraulic thruster 20 may incorporate a steering motor 96 and tube gear 92 steering system. This system may be used where a single lower unit 50 is mounted to hydraulic thruster 20, as is depicted in FIG. 9, or in a dual lower unit 50 configuration. In this configuration, steering motor 96 is mounted to housing 70. Steering motor 96 drives steering motor gear 98, which in turn drives tube gear 92 and tube gear clamp 94, which then rotates the tube 54 to which tube gear clamp 94 is clamped. A dual lower unit 50 embodiment would incorporate a steering clamp arm 60 rigidly attached to each steering clamp 64, and tie rod 36 joining the distal ends of the steering clamp arms 60.

FIG. 5 also illustrates the instant hydraulic thruster 20 in the storage or transportation configuration. In this configuration, lower unit 50 is fully retracted and tilted up, and pins 40 are removed from base bores 38. Thus configured, hydraulic thruster sits flat on the flat surface 116 upon which it rests, be that surface a flat bed truck, container floor, warehouse, or other resting location. This compact storage/transportation configuration saves time and space when loading the instant hydraulic thruster into a container (it can simply be wheeled in on a float), truck, or other storage/transportation surface.

Figure 7:
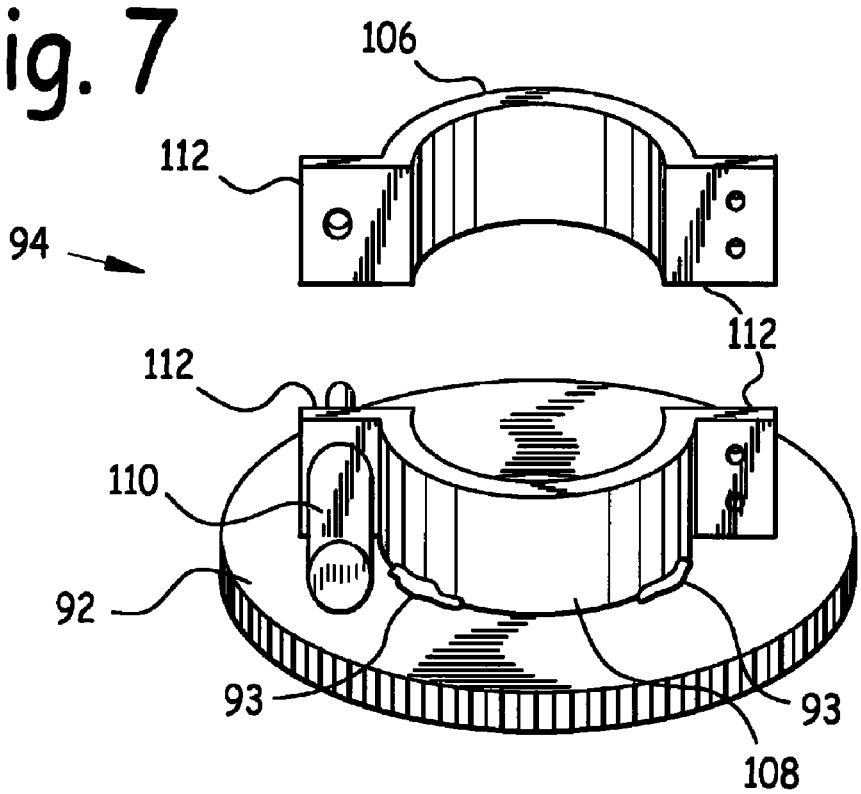
FIG. 7 is a front elevated view of a tube gear clamp, with its tube gear clamp first half unattached from its tube gear clamp second half.
Figure 8:
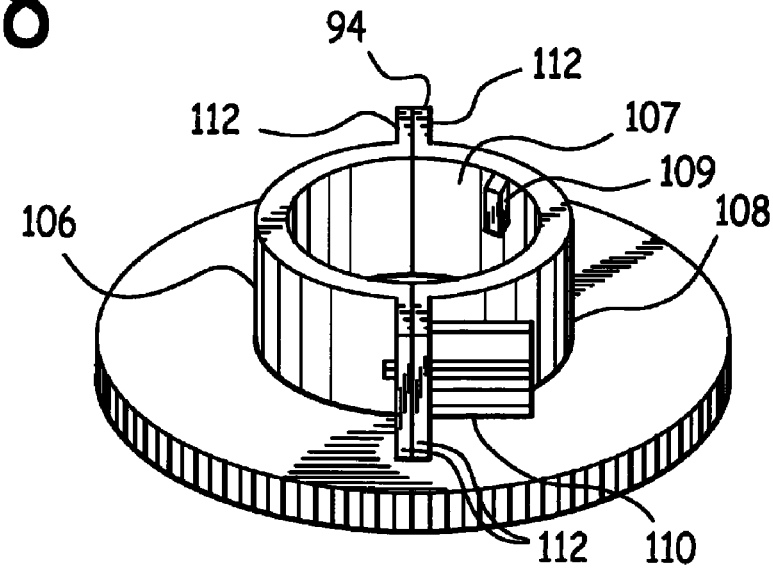
FIG. 8 is a side elevated view of a tube gear clamp, with its tube gear clamp first half attached to its tube gear clamp second half.

FIG. 7 is a front elevated view of a tube gear clamp 94, with its tube gear clamp first half 106 unattached from its tube gear clamp second half 108. FIG. 8 is a side elevated view of a tube gear clamp 94, with its tube gear clamp first half 106 attached to its tube gear clamp second half 108.

Tube 54 is sized to slidably fit into cylinder bore 53 in cylinder 52. Thus, tube 54 is free to rotate and reciprocate within cylinder 52. Referring now to FIG. 7, a front elevated view of tube gear clamp 94, with its tube gear clamp first half 106 unattached from its tube gear clamp second half 108; and FIG. 8, a side elevated view of tube gear clamp 94, with its tube gear clamp first half 106 attached to its tube gear clamp second half 108; we observe that reversible steering motor 96 drives steering motor gear 98, which in turn drives tube gear 92. Tube gear 92 is rigidly attached to tube gear clamp second half 108, and steering motor 96 is rigidly attached to housing 20. In the preferred embodiment, tube gear clamp second half 108 was attached to tube gear 92 with welds 93.

Tube gear clamp 94 contains tube gear clamp bore 107, which is sized to slidably admit tube 54. Tube gear clamp key 109 extends into tube gear clamp bore 107, and is sized to slidably reciprocate within tube keyway 73 in tube 54, as depicted in FIG. 4. Tube keyway 73 is disposed longitudinally on the outside surface of tube 54.

Tube gear clamp key 109 reciprocating within tube keyway 73 prevents tube 54 from rotating relative to tube gear clamp 94 and tube gear 92. Thus, when steering motor 96 turns tube gear 92 and rigidly attached tube gear clamp 94, tube 54 turns at the same rate, thereby providing a steering function to hydraulic thruster for vessel 20.

The top view shape of tube gear clamp first half 106 and tube gear second half 108 is substantially a 180 degree arc of a circle, with a tube gear clamp flange 112 on each end. When mounted to tube 54, tube gear clamp first half 106 and tube gear second half 108 are emplaced around tube 54 such that tube 54 is slidably disposed within tube gear clamp bore 107. Then a tube gear clamp first half 106 flange 112 is attached to a corresponding tube gear second half 108 flange 112 (using fasteners such as bolts, in the preferred embodiment), as depicted in FIG. 8.

Fasteners such as bolts or screws through both flanges 112 may be used to manually tighten (and loosen) tube gear clamp 94 on tube 54, or alternately, tube gear clamp actuator 110 may mounted to one of the two remaining unattached flanges 112, and its actuator attached to the other remaining unattached flanges 112, as depicted in FIG. 8. Tube gear clamp actuator 110 serves to loosen and tighten tube gear clamp 94 on tube 54. Tube gear clamp 94 must be loosened, or opened, prior to extending or retracting tube 54 within cylinder 52, and tube gear clamp actuator 110 permits the opening and closing of tube gear clamp 94 to be accomplished remotely.

Following extension or retraction of tube 54, tube gear clamp 94 must be closed or tightened, in order to help prevent tube 54 from rotating within tube gear clamp 94 while steering, and to lock tube 54 into position relative to cylinder 52 axially.

FIG. 9 is an elevated left rear quarter isometric views of a hydraulic thruster 20 embodiment having a single lower unit 50. Thus, the instant disclosure teaches both single and dual lower unit 50 embodiments of the instant hydraulic thruster 20. Both embodiments enjoy the benefits of a strong, redundant tilt actuator system whose components are not immersed in water, thus reducing corrosion due to moisture; two types of positive down-tilt stop; pins 40 through base bores 38 to position the hydraulic thruster 20 on a vessel stern 4 without permanent downwards-protruding member(s), and effective long extension/retraction travel extension actuators 35.

The steering actuator 34/steering clamp arm 60 steering system depicted in FIGS. 1-3 may be used with either the single lower unit 50 hydraulic thruster 20 embodiment, or the dual lower unit 50 hydraulic thruster 20 embodiment. The dual lower unit 50 hydraulic thruster 20 embodiment is illustrated in FIGS. 1-3; in the case of the single lower unit 50 hydraulic thruster 20 embodiment tie rod 36 would be omitted.

Similarly, the steering motor 96/steering motor gear 98/tube gear 92 steering system may be used with either the single lower unit 50 hydraulic thruster 20 embodiment, or the dual lower unit 50 hydraulic thruster 20 embodiment. The single lower unit 50 hydraulic thruster 20 embodiment is illustrated in FIG. 9; in the case of the dual lower unit 50 hydraulic thruster 20 embodiment tie rod 36 joining distal ends of steering clamp arms 60 would be included.

In the preferred embodiment, base 30, helm platform 26, helm 24, hydraulic fluid reservoir 28, housing 70, tube 54, cylinder 52, tube gear clamp 94, and tube gear were made using metal, synthetic, corrosion resistant metal, corrosion resistant metal fasteners, welded construction, or other appropriate materials and processes. Steering motor 96, steering motor gear 98, tube gear 92, steering actuator 34, tilt actuator 32, extension actuator 35, tube gear clamp actuator 110 and hydraulic power pack 22 were commercially available items. Steering actuator 34, tilt actuator 32, extension actuator 35, and tube gear clamp actuator 110 may be hydraulic actuators, electric linear motors, or any other appropriate actuators. Base 30 and base upper surface 31 were made of plates, C beams, I beams, or any other appropriate structural member shape.

While a preferred embodiment of the invention has been illustrated herein, it is to be understood that changes and variations may be made by those skilled in the art without departing from the spirit of the appending claims.

DRAWING ITEM INDEX

2 vessel
4 vessel stern
20 hydraulic thruster
22 hydraulic power pack
24 helm
26 helm platform
28 hydraulic fluid reservoir
30 base
31 base upper surface
32 tilt actuator
34 steering actuator
35 extension actuator
36 tie rod
38 base bore
40 pin
42 arrow
43 arrow
44 base lower unit cutout
45 base lower unit cutout wall
46 down stop tab
50 lower unit
52 cylinder
53 cylinder bore
54 tube
56 propeller
58 steering clamp
59 steering clamp aperture
60 steering clamp arm
62 tube key
64 steering clamp keyway
70 housing
72 housing cylinder bore
73 tube keyway
74 housing arm
75 housing arm lower edge
76 housing roof
78 housing side
80 housing floor
82 pivot point
84 pivot tab
86 arrow
87 arrow
88 arrow
92 tube gear
93 weld
94 tube gear clamp
96 steering motor
98 steering motor gear
100 swivel union
106 tube gear clamp first half
107 tube gear clamp bore
108 tube gear clamp second half
109 tube gear clamp key
110 tube gear clamp actuator
112 tube gear clamp flange
114 actuator collar
116 flat surface

I claim:

1. A hydraulic thruster comprising at least one lower unit tiltably attached to a base;

said base comprising a base upper surface and a base lower unit cutout corresponding to each said lower unit;

said lower unit comprising a housing, a cylinder extending through said housing and extending below said housing, a tube slidably and rotatably disposed within said cylinder, said housing being slidably and tiltably disposed within said base lower unit cutout, said cylinder extending completely through said housing; and means to tilt said cylinder relative to said base.

2. The hydraulic thruster for vessel of claim 1 wherein said tube extends completely through said housing.

3. A hydraulic thruster comprising at least one lower unit tiltably attached to a base;

said base comprising a base upper surface and a base lower unit cutout corresponding to each said lower unit;

said lower unit comprising a housing, a cylinder extending through said housing and extending below said housing, a tube slidably and rotatably disposed within said cylinder, said housing being slidably and tiltably disposed within said base lower unit cutout; and means to tilt said cylinder relative to said base comprising at least one housing arm rigidly attached to and extending upwards from a housing side, and a tilt actuator, one end of said tilt actuator being attached to an end of said housing arm opposite said housing, the other end of said tilt actuator being attached to said base upper surface, wherein said tilt actuator is disposed entirely above said base upper surface and no part of said tilt actuator is disposed below water.

4. The hydraulic thruster of claim 3 further comprising positive down-tilt stop means, said positive down-tilt stop means comprising said housing being tiltably attached to said base at at least one pivot point, said pivot point being positioned at a front area of said housing wall such that a portion of said housing wall extends above said base upper surface when said housing is tilted completely down, each said housing arm having a housing arm lower edge, each said housing arm being attached to an aft area of a respective said housing wall such that said housing arm lower edge rests on said base upper surface when said housing is tilted completely down, whereby each said housing arm lower edge resting on said base upper surface provides a positive down-tilt stop when said housing is tilted completely down.

5. The hydraulic thruster of claim 4 wherein said positive down-tilt stop means further comprises a down stop tab rigidly attached to a corresponding base lower unit cutout wall, said down stop tab extending into said lower unit cutout, whereby when said housing is tilted completely down, a front edge of a corresponding housing wall butts against said down stop tab, thereby providing a positive down-tilt stop for said lower unit when said lower unit is tilted completely down.

6. The hydraulic thruster of claim 5 further comprising at least one pivot tab rigidly attached to and extending upwards from said base upper surface, one said pivot point being disposed in each said pivot tab, whereby said pivot point is disposed above said base upper surface, said housing extending above said base upper surface and said base upper surface being disposed at substantially a mid-height of said housing wall when said housing is tilted completely down, whereby said housing arm may be attached to an upper aft area of said housing wall such that said housing arm lower edge is disposed at substantially a mid-height of said housing wall.

7. The hydraulic thruster of claim 4 further comprising a steering motor attached to said housing, a steering motor gear driven by said steering motor, a steering clamp tightenably attached to said tube, a steering clamp aperture in said steering clamp sized to slidably admit said tube, a tube gear attached to said steering clamp, a steering clamp keyway inside said steering clamp aperture, a tube key on an outside surface of said key, said steering motor gear meshing with and driving said tube gear, said steering clamp keyway sized to slidably admit said tube key.

8. The hydraulic thruster of claim 4 further comprising a steering clamp tightenably attached to an upper end of said tube, a steering clamp arm extending radially from said steering clamp, a steering clamp aperture in said steering clamp sized to slidably admit said tube, a steering clamp keyway in said steering clamp aperture, a tube key on an upper end of said tube, and a steering actuator, one end of said steering actuator being attached to an end of said steering clamp arm opposite said tube, another end of said steering actuator being attached to said base upper surface, said steering clamp keyway being sized to slidably admit said tube key.

9. The hydraulic thruster of claim 4 wherein said hydraulic thruster comprises two said lower units, each said lower unit being tiltably disposed within a respective said base lower unit cutout, a steering clamp tightenably attached to an upper end of each said tube, a steering clamp arm extending radially from each said steering clamp, a steering clamp aperture in each said steering clamp sized to slidably admit a respective said tube, a steering clamp keyway in each said steering clamp aperture, a tube key on an upper end of each said tube, a tie rod connecting ends of said steering clamp arms opposite their respective tubes, and a steering actuator, one end of said steering actuator being attached to an end of one said steering clamp arm opposite its respective said tube, another end of said steering actuator being attached to one said housing, said steering clamp keyway being sized to slidably admit said tube key.

10. The hydraulic thruster of claim 4 further comprising an actuator collar slidably encircling said tube above said housing, and at least one extension actuator, one end of said at least one extension actuator being attached to said actuator collar, and another end of said at least one extension actuator being attached to a lower end of said cylinder below said housing.

11. The hydraulic thruster of claim 10 further comprising a steering motor attached to said housing, a steering motor gear driven by said steering motor, a steering clamp tightenably attached to said tube, a steering clamp aperture in said steering clamp sized to slidably admit said tube, a tube gear attached to said steering clamp, a steering clamp key extending radially inwards inside said steering clamp aperture, a tube keyway on an outside surface of said tube, said steering motor gear meshing with and driving said tube gear, said tube keyway sized to slidably admit said steering clamp key.

12. The hydraulic thruster of claim 4 wherein a ratio of a length of said cylinder to a length of said tube is substantially between 0.25 and 0.35.

13. The hydraulic thruster of claim 3 further comprising a steering motor attached to said housing, a steering motor gear driven by said steering motor, a steering clamp tightenably attached to said tube, a steering clamp aperture in said steering clamp sized to slidably admit said tube, a tube gear attached to said steering clamp, a steering clamp keyway inside said steering clamp aperture, a tube key on an outside surface of said key, said steering motor gear meshing with and driving said tube gear, said steering clamp keyway sized to slidably admit said tube key.

14. The hydraulic thruster of claim 3 further comprising a steering clamp tightenably attached to an upper end of said tube, a steering clamp arm extending radially from said steering clamp, a steering clamp aperture in said steering clamp sized to slidably admit said tube, a steering clamp keyway in said steering clamp aperture, a tube key on an upper end of said tube, and a steering actuator, one end of said steering actuator being attached to an end of said steering clamp arm opposite said tube, another end of said steering actuator being attached to said base upper surface, said steering clamp keyway being sized to slidably admit said tube key.

15. The hydraulic thruster of claim 3 wherein said hydraulic thruster comprises two said lower units, each said lower unit being tiltably disposed within a respective said base lower unit cutout, a steering clamp tightenably attached to an upper end of each said tube, a steering clamp arm extending radially from each said steering clamp, a steering clamp aperture in each said steering clamp sized to slidably admit a respective said tube, a steering clamp keyway in each said steering clamp aperture, a tube key on an upper end of each said tube, a tie rod connecting ends of said steering clamp arms opposite their respective tubes, and a steering actuator, one end of said steering actuator being attached to an end of one said steering clamp arm opposite its respective said tube, another end of said steering actuator being attached to one said housing, said steering clamp keyway being sized to slidably admit said tube key.

16. The hydraulic thruster of claim 3 further comprising an actuator collar slidably encircling said tube above said housing, and at least one extension actuator, one end of said at least one extension actuator being attached to said actuator collar, and another end of said at least one extension actuator being attached to a lower end of said cylinder below said housing.

17. The hydraulic thruster of claim 16 further comprising a steering motor attached to said housing, a steering motor gear driven by said steering motor, a steering clamp tightenably attached to said tube, a steering clamp aperture in said steering clamp sized to slidably admit said tube, a tube gear attached to said steering clamp, a steering clamp key extending radially inwards inside said steering clamp aperture, a tube keyway on an outside surface of said key, said steering motor gear meshing with and driving said tube gear, said tube keyway sized to slidably admit said steering clamp key.

18. The hydraulic thruster of claim 3 wherein a ratio of a length of said cylinder to a length of said tube is substantially between 0.25 and 0.35.

19. A hydraulic thruster comprising at least one lower unit tiltably attached to a base;

said base comprising a base upper surface, a base lower unit cutout corresponding to each said lower unit, at least one base bore disposed through said base, and a pin corresponding to each said base bore, said pin being sized to slidably fit through said base bore, a length of said pin exceeding a thickness of said base, whereby when said pin is inserted through said base bore a portion of said pin protrudes below said base to serve as a stop to position said hydraulic thruster on a vessel stern, said pin being removable from said base bore for storage or transportation of said hydraulic thruster;

said lower unit comprising a housing, a cylinder extending through said housing and extending below said housing, a tube slidably and rotatably disposed within said cylinder, said housing being slidably and tiltably disposed within said base lower unit cutout; and means to tilt said cylinder relative to said base.

20. The hydraulic thruster of claim 19 further comprising a steering motor attached to said housing, a steering motor gear driven by said steering motor, a steering clamp tightenably attached to said tube, a steering clamp aperture in said steering clamp sized to slidably admit said tube, a tube gear attached to said steering clamp, a steering clamp keyway inside said steering clamp aperture, a tube key on an outside surface of said tube, said steering motor gear meshing with and driving said tube gear, said steering clamp keyway sized to slidably admit said tube key.

21. The hydraulic thruster of claim 19 further comprising a steering clamp tightenably attached to an upper end of said tube, a steering clamp arm extending radially from said steering clamp, a steering clamp aperture in said steering clamp sized to slidably admit said tube, a steering clamp keyway in said steering clamp aperture, a tube key on an upper end of said tube, and a steering actuator, one end of said steering actuator being attached to an end of said steering clamp arm opposite said tube, another end of said steering actuator being attached to said base upper surface, said steering clamp keyway being sized to slidably admit said tube key.

22. The hydraulic thruster of claim 19 wherein said hydraulic thruster comprises two said lower units, each said lower unit being tiltably disposed within a respective said base lower unit cutout, a steering clamp tightenably attached to an upper end of each said tube, a steering clamp arm extending radially from each said steering clamp, a steering clamp aperture in each said steering clamp sized to slidably admit a respective said tube, a steering clamp keyway in each said steering clamp aperture, a tube key on an upper end of each said tube, a tie rod connecting ends of said steering clamp arms opposite their respective tubes, and a steering actuator, one end of said steering actuator being attached to an end of one said steering clamp arm opposite its respective said tube, another end of said steering actuator being attached to one said housing, said steering clamp keyway being sized to slidably admit said tube key.

23. The hydraulic thruster of claim 19 further comprising an actuator collar slidably encircling said tube above said housing, and at least one extension actuator, one end of said at least one extension actuator being attached to said actuator collar, and another end of said at least one extension actuator being attached to a lower end of said cylinder below said housing.

24. The hydraulic thruster of claim 23 further comprising a steering motor attached to said housing, a steering motor gear driven by said steering motor, a steering clamp tightenably attached to said tube, a steering clamp aperture in said steering clamp sized to slidably admit said tube, a tube gear attached to said steering clamp, a steering clamp key extending radially inwards inside said steering clamp aperture, a tube keyway on an outside surface of said key, said steering motor gear meshing with and driving said tube gear, said tube keyway sized to slidably admit said steering clamp key.

25. The hydraulic thruster of claim 19 wherein a ratio of a length of said cylinder to a length of said tube is substantially between 0.25 and 0.35.

26. A hydraulic thruster comprising a base, a power pack mounted at a forward end of said base, a helm platform mounted at an aft end of said base, a helm mounted to said helm platform, and a hydraulic fluid reservoir mounted to said helm platform;

said base comprising a base lower unit cutout on either side of said helm platform, each said base lower unit cutout being laterally offset from helm platform and disposed at an aft edge of said base;

each said lower unit comprising a housing, a cylinder extending through said housing and extending below said housing, a tube slidably and rotatably disposed within said cylinder, and a propeller at a lower end of said tube, said housing being slidably and tiltably disposed within said base lower unit cutout; and at least one housing arm rigidly attached to and extending upwards from a housing side, and a tilt actuator, one end of said tilt actuator being attached to an end of said housing arm opposite said housing, the other end of said tilt actuator being attached to said base upper surface, wherein said tilt actuator is disposed entirely above said base upper surface and no part of said tilt actuator is disposed below water.

27. The hydraulic thruster of claim 26 further comprising positive down-tilt stop means, said positive down-tilt stop means comprising said housing being tiltably attached to base at least one pivot point, said pivot point being positioned at a front area of said housing wall such that a portion of said housing wall extends above said base upper surface when said housing is tilted completely down, each said housing arm having a housing arm lower edge, each said housing arm being attached to an aft area of a respective said housing wall such that said housing arm lower edge rests on said base upper surface when said housing is tilted completely down, whereby each said housing arm lower edge resting on said base upper surface provides a positive down-tilt stop when said housing is tilted completely down.

28. The hydraulic thruster of claim 27 wherein said positive down-tilt stop means further comprises a down stop tab rigidly attached to a corresponding base lower unit cutout wall, said stop tab extending into said lower unit cutout, whereby when said housing is tilted completely down, a front edge of a corresponding housing wall butts against said down stop tab, thereby providing a positive down-tilt stop for said lower unit when said lower unit is tilted completely down.

29. The hydraulic thruster of claim 27 further comprising at least one pivot point tab rigidly attached to and extending upwards from said base upper surface, one said pivot point being disposed in each said pivot point tab, whereby a said pivot point is disposed above said base upper surface, said housing extending above said base upper surface and said base upper surface and being disposed at substantially a mid-height of said housing wall when said housing is tilted completely down, whereby said housing arm may be attached to an upper aft area of said housing wall such that said housing arm lower edge is disposed at substantially a mid-height of said housing wall.

30. The hydraulic thruster of claim 26 comprising a base bore disposed through said base immediately forward of each said base lower unit cutout, and a pin corresponding to each said base bore, said pin being sized to slidably fit through said base bore, a length of said pin exceeding a thickness of said base, whereby when said pin is inserted through said base bore a portion of said pin protrudes below said base to serve as a stop to position said hydraulic thruster on a vessel stern, said pin being removable from said base bore for storage or transportation of said hydraulic thruster.

* * * * *